United States Patent [19]

Dompas et al.

[11] 4,298,053

[45] Nov. 3, 1981

[54] CASTING BELTS FOR MACHINES FOR THE CONTINUOUS CASTING OF METALS

[75] Inventors: John Dompas, Olen, Belgium; Charles J. Petry, Winooski, Vt.

[73] Assignee: Metallurgie Hoboken-Overpelt, Brussels, Belgium

[21] Appl. No.: 556,370

[22] Filed: Mar. 7, 1975

[30] Foreign Application Priority Data

Mar. 18, 1974 [FR] France ..... 74 09061

[51] Int. Cl.[3] ..... B22D 11/06; B23K 28/00

[52] U.S. Cl. ..... 164/429; 228/214

[58] Field of Search ..... 164/268, 75, 102, 107, 164/72, 100, 429, 432, 433; 29/195 C, 196.2, 527.4, 196.6, 527.4; 228/214, 226; 427/405; 75/123 M

[56] References Cited

U.S. PATENT DOCUMENTS

| | | | |
|---|---|---|---|
| 1,890,595 | 12/1932 | Valenta | 75/123 M |
| 1,959,791 | 5/1934 | Kautz | 228/226 |
| 2,206,888 | 7/1940 | Greenidge | 164/73 |
| 2,725,617 | 12/1955 | Sternberg | 29/195 C |
| 2,815,436 | 12/1957 | Bland | 228/226 X |
| 2,898,234 | 8/1959 | Nack | 427/405 X |
| 2,963,129 | 12/1960 | Eberle | 228/226 X |
| 2,968,865 | 1/1961 | Rey | 427/405 X |
| 3,036,348 | 5/1962 | Hazelett | 164/278 |
| 3,115,395 | 12/1963 | Putt | 29/195 C X |
| 3,507,032 | 4/1970 | Foerster | 29/527.4 |
| 3,645,767 | 2/1972 | Taylor | 164/72 X |
| 3,721,534 | 3/1973 | Kubick | 29/196.2 X |
| 3,795,269 | 3/1974 | Leconte | 164/268 X |
| 3,881,882 | 5/1975 | Hughes | 29/196.2 |
| 3,904,378 | 9/1975 | Higbee | 29/196.6 X |

*Primary Examiner*—Robert D. Baldwin
*Assistant Examiner*—John S. Brown
*Attorney, Agent, or Firm*—Fred Philpitt

[57] ABSTRACT

An endless casting belt for machines for continuous casting of metals, said casting belt being provided with a layer of an anti-adhesion agent and having at least in the "welding zone" a coating resistant to stress corrosion cracking when in contact with the liquid metal to be cast and with the said anti-adhesion agent.

2 Claims, 5 Drawing Figures

FIG. 1
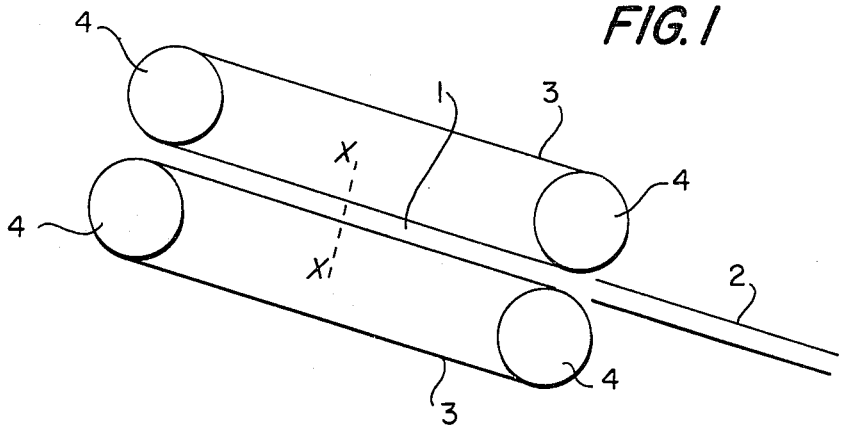
FIG. 2
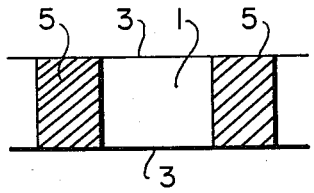
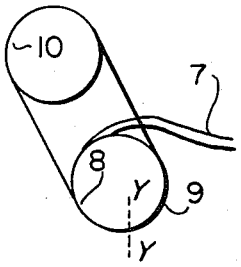
FIG. 3
FIG. 4
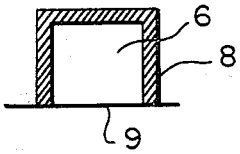
FIG. 5
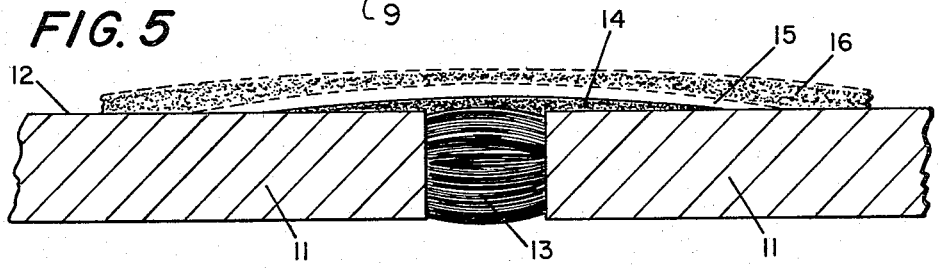

CASTING BELTS FOR MACHINES FOR THE CONTINUOUS CASTING OF METALS

The present invention relates to an endless casting belt for machines for the continuous casting of metals, more particularly for continuous casting machines the molding cavity of which is formed by a pair of casting belts moving in a parallel direction and by two side dams separating the said belts, such as made for example by Hazelett Strip-Casting Corporation, and for those the molding cavity of which is formed by the groove of a wheel enclosed by a casting belt, such as those made for example by S.p.A Continuus (Properzi), and The Southwire Company.

Such continuous casting machines are diagrammatically illustrated by the accompanying drawings, in which:

FIG. 1 is a longitudinal section made across a twin-belt caster;

FIG. 2 is a section, on a larger scale, of the casting device made along line X—X of FIG. 1;

FIG. 3 is a longitudinal section made across a wheel caster, and

FIG. 4 is a section, on a larger scale, of the casting device made along line Y—Y of FIG. 3.

FIG. 5 is an enlarged longitudinal section of a welding zone of a belt in accordance with this invention.

Referring to the drawings, the moulding cavity 1 of a twin-belt caster from which issues the casting 2 is formed by two endless belts 3 rotating around drums 4 and by two side dams 5, which move forward in the same direction as the belt 3. The moulding cavity 6 of a wheel caster from which issues the casting 7 is formed by the groove of a casting wheel 8 and by an endless belt 9 which rotates around the casting wheel 8 and the wheel 10.

In FIG. 5, 11 represents the belt, 12 the casting side of the belt, 13 the weld of the belt, 14 a primer layer and 15 a coating resistant to stress corrosion cracking when in contact with the metal to be cast or with the anti-adhesion agent 16.

The casting belt according to the present invention is particularly well suited for the casting of metals with a high melting point, such as copper and steel.

Up to now, such casting belts were mostly made by welding together the two ends of a belt of mild killed steel, that is a steel having a low carbon content (lower than 0.2% by weight), free from special elements voluntarily added, and deoxidized, for instance with silicon, manganese or aluminium. A casting belt of the prior art has the drawback of becoming rapidly worn when used for casting metals having a high melting point, such as copper and steel.

Recently, the life of such a belt of the prior art was increased threefold by using for its construction a mild killed steel containing 0.2 to 0.8% by weight of titanium. This steel is commercialized under the name "Contiloy".

The present invention has for its object further to increase the life of the casting belt.

Up to now, it was generally admitted that the deterioration of a casting belt was due to thermal and mechanical stresses to which the belt is submitted during the casting process.

It has now been found that the deterioration of a casting belt is mainly due to the combined action of the mechanical stress to which the belt is necessarily submitted during the casting process in order to keep it in the correct position, and of the corrosion produced on the casting side of the belt by the liquid metal which is cast and, in the event of coating the belt with an anti-adhesion agent, also by said agent. This phenomenon is designated by corrosion specialists by the expression "Stress corrosion cracking". It has also been found that the zone adjacent to the weld of the belt, which has been affected by the welding heat and which will be hereafter, together with the weld, designated as "the welding zone", is particularly exposed to said stress corrosion cracking.

The present invention consists of an endless casting belt obtained by welding together the two ends of a metallic band, for use in machines for the continuous casting of metals, said belt being provided with a layer of an anti-adhesion agent, and the casting side of the said belt being covered, at least in the welding zone, with a coating resistant to stress corrosion cracking when in contact with the liquid metal to be cast or with the said anti-adhesion agent.

The said coating may advantageously be made of chromium, or of an alloy of chromium, or of nickel, or of an alloy of nickel, or of a stainless steel.

The thickness of the said coating will preferably be comprised between 0.01 and 0.5 mm.

The said coating may be applied by any known process, such as electrochemical plating, chemical plating, or plating by spraying with a molten metal, possibly after the surface to be protected has received a thin layer of a primer known "per se", for improving the adhesion of a protective coating afterwards applied.

The welding zone, that is the weld and the adjacent metal, will most often have a width comprised between 25 and 80 mm.

The casting belt itself is preferably made of mild killed steel containing 0.2 to 0.8% in weight of titanium.

EXAMPLE

A band of mild killed steel containing 0.4% by weight of titanium has been transformed into an endless belt by welding together its two ends. The welding was carried out in an atmosphere of argon with a tungsten electrode ("Tungsten Inert Gas Welding") and with addition of a steel containing titanium (0.1% in weight of Ti).

On the casting side of the endless belt thus obtained, that is on the side which will face the liquid metal during the casting process, the welding zone (weld and adjacent metal), which has a width of about 50 mm., is treated, after the weld has been ground down, in the following way. In the first place, a "primer" layer of a nickel-aluminium alloy of a thickness of 0.005 mm (80% by weight of Ni, 20% by weight of Al), commercialized under the name of "Metco 405" by the Metallizing Engineering Company, Inc., is applied by spray gunning, and then a protective layer is applied of a thickness of about 0.2 mm of chromium steel (13% by weight of Cr), commercialized by the firm above mentioned under the name "Metcolloy No. 2".

The casting belt thus treated has a life of about thirty hours when it is used, coated with a colloidal graphite anti-adhesion agent, for the casting of copper. Without such a protective treatment of the welding zone, the life of the casting belt is of about 15 hours only under analogous casting conditions.

What we claim is:

1. An endless casting belt for use on a machine for the continuous casting of metals, said endless belt consisting essentially of a belt of mild killed steel containing 0.2 to 0.8% by weight of titanium, said belt having been welded together at its ends in a "welding zone" to form an endless belt, an 0.05 mm thick primer layer of an 80:20 nickel-aluminum alloy overlying said welding zone, a first coating between 0.01 and 0.5 mm thick covering said primer layer, said first coating being selected from the group consisting of chromium, chromium alloy, nickel, nickel alloy and stainless steel, and a second coating of colloidal graphite covering said first coating.

2. An endless casting belt according to claim 1 wherein said first coating covers the entire casting surface of said endless casting belt.

* * * * *